US009091074B2

(12) United States Patent
Schucker

(10) Patent No.: US 9,091,074 B2
(45) Date of Patent: Jul. 28, 2015

(54) DECORATIVE MOLDING WITH INTEGRATED SUSPENSION MEMBERS

(71) Applicant: Terrie Schucker, Bernville, PA (US)

(72) Inventor: Terrie Schucker, Bernville, PA (US)

( * ) Notice: Subject to any disclaimer, the term of this patent is extended or adjusted under 35 U.S.C. 154(b) by 121 days.

(21) Appl. No.: 14/027,275

(22) Filed: Sep. 16, 2013

(65) Prior Publication Data

US 2015/0075094 A1 Mar. 19, 2015

(51) Int. Cl.

| | |
|---|---|
| ***E04B 2/00*** | (2006.01) |
| ***E04F 19/02*** | (2006.01) |
| ***E04F 19/04*** | (2006.01) |
| ***E04F 19/06*** | (2006.01) |

(52) U.S. Cl.

CPC ..... *E04F 19/02* (2013.01); *E04F 19/04* (2013.01); *E04F 19/061* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 303,356 | A * | 8/1884 | Beck | 52/312 |
| 3,225,940 | A * | 12/1965 | Story | 211/153 |
| 3,599,916 | A * | 8/1971 | Szabo | 248/73 |
| 4,274,237 | A * | 6/1981 | Hagstrom | 52/312 |
| 4,852,832 | A * | 8/1989 | Delaney | 248/65 |
| 5,001,877 | A * | 3/1991 | Edwards | 52/288.1 |
| 5,067,061 | A * | 11/1991 | Prickett | 362/145 |
| 5,141,192 | A * | 8/1992 | Adams | 248/231.81 |
| 5,457,923 | A * | 10/1995 | Logan et al. | 52/288.1 |
| 5,463,835 | A * | 11/1995 | Wood | 52/288.1 |
| 5,525,384 | A * | 6/1996 | Gilmore et al. | 428/31 |
| D373,948 | S * | 9/1996 | Etzel et al. | D8/367 |
| 5,564,233 | A * | 10/1996 | Norton | 52/60 |
| 5,806,823 | A * | 9/1998 | Callas | 248/320 |
| 6,494,594 | B1 * | 12/2002 | Schroetter | 362/249.01 |
| 6,725,614 | B2 * | 4/2004 | Schiedegger et al. | 52/211 |
| 6,910,310 | B2 * | 6/2005 | Bower et al. | 52/716.1 |
| 7,066,618 | B1 * | 6/2006 | Little | 362/147 |
| 7,188,977 | B1 * | 3/2007 | Lough | 362/396 |
| 7,487,623 | B2 * | 2/2009 | Rodolofo et al. | 52/716.1 |
| 7,784,240 | B2 * | 8/2010 | Miller | 52/710 |
| 7,823,853 | B2 * | 11/2010 | Larson et al. | 248/339 |
| 7,997,043 | B1 * | 8/2011 | MacMillan et al. | 52/716.8 |
| 8,015,755 | B2 * | 9/2011 | Miller et al. | 52/97 |
| 8,104,234 | B1 * | 1/2012 | Sawyer | 52/96 |
| 8,850,766 | B1 * | 10/2014 | Malinajdovski | 52/312 |
| 2003/0066938 | A1 * | 4/2003 | Zimmerman | 248/301 |
| 2003/0094822 | A1 * | 5/2003 | Hill et al. | 294/19.1 |
| 2003/0115813 | A1 * | 6/2003 | Wong Hahn | 52/288.1 |
| 2004/0151540 | A1 * | 8/2004 | Clements et al. | 403/408.1 |

* cited by examiner

*Primary Examiner* — Monica Millner
(74) *Attorney, Agent, or Firm* — Gulf Coast Intellectual Property Group

(57) ABSTRACT

A decorative molding located on the interior surface of a wall configured to releasably secure an object adjacent to the interior surface of the wall. The decorative molding further includes an upper portion and a lower portion. The lower portion is configured with a laterally oriented channel that is substantially the length of the body. A plurality of slots perpendicularly engage the channel and function to receive therein a suspension member. The suspension member is configured with a first end operable to engage the channel and extend downward through the slot. The suspension member has a second end distal from the first end that is configured to releasably receive an object thereon so as to suspend against the surface of the wall to which the molding is mounted.

10 Claims, 2 Drawing Sheets

DECORATIVE MOLDING WITH INTEGRATED SUSPENSION MEMBERS

FIELD OF THE INVENTION

The present invention relates to a decorative molding, more specifically but not by way of limitation, decorative molding such as but not limited to crown molding or chair rail molding that is configured to suspend an object adjacent the wall to which the molding is secured utilizing a plurality of suspension members that are releasably secured to a portion of the decorative molding.

BACKGROUND

Whether its an apartment home or a single family home, millions of home owners participate in the ritual of decorating their interior in order to design the interior of the home to their specific taste. Interior decorating can consist of hanging a painting or picture on a wall or placing seasonal items in the interior of the home for particular seasons such as but not limited to Christmas.

Typically, when homeowners want to suspend an item on the wall there are several conventional available methods. One common method for suspending an item such as a painting or plate on the wall is a mechanical fastener such as but not limited to a nail. Utilizing this method the homeowner will drive the nail into the wall possibly utilizing an additional bracket in the desired location in order to releasably secure the painting or plate to the wall. This method causes damage to the wall leaving an aperture in the wall that must be cosmetically repaired upon removal of the decorative item. Additionally some interior wall materials, such as but not limited to plaster, can be damage significantly by fasteners such as nails and screws.

Another common method for suspending decorative items against an interior wall is a hook with an adhesive backing While these types of devices do not require to be journaled into the wall to which they are fastened, the adhesives utilize typically do not have a bond to the wall that allows the suspension of any decorative item that is greater than a couple of pounds. Additionally, these adhesives have shown to be sensitive to temperature and moisture and can break down over a short period of time causing the decorative item to fall from the wall. These types of devices can typically only suspend one decorative item per device.

Accordingly, there is a need for a device that can suspend a decorative item against a wall that does not require the need to be journaled into the wall and does not utilize adhesives to be releasably secured to the wall. Additionally, the device should be configurable to suspend a plurality of decorative items on the wall.

SUMMARY OF THE INVENTION

It is the object of the present invention to provide a decorative molding such as but not limited to crown molding that can suspend at least one decorative item against the interior of a wall.

Another object of the present invention is to provide a decorative molding that can suspend at least one decorative item against a wall of a home that is configured to integrally receive a plurality of suspension members in order to suspend the at least one decorative item.

Yet a further object of the present invention is to provide a decorative molding that can suspend at least one decorative item that utilizes suspension members being configured with different lengths.

Still another object of the present invention is to provide a decorative molding having a lower portion that further includes a laterally oriented channel and a plurality of perpendicular slots configured to releasably secure the suspension members to the decorative molding.

An additional object of the present invention is to provide a decorative molding that can suspend at least one decorative item that further includes a removable member functioning to cosmetically conceal the lower portion of the decorative molding proximate the engagement area of the suspension members.

Yet another object of the present invention is to provide a decorative molding that can suspend at least one decorative item against a wall that substantially inhibits any damage to the wall as a result of the suspension of the decorative item.

Another object of the present invention is to provide a decorative molding that can suspend at least one decorative item against a wall wherein the suspension members are easily interchanged.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
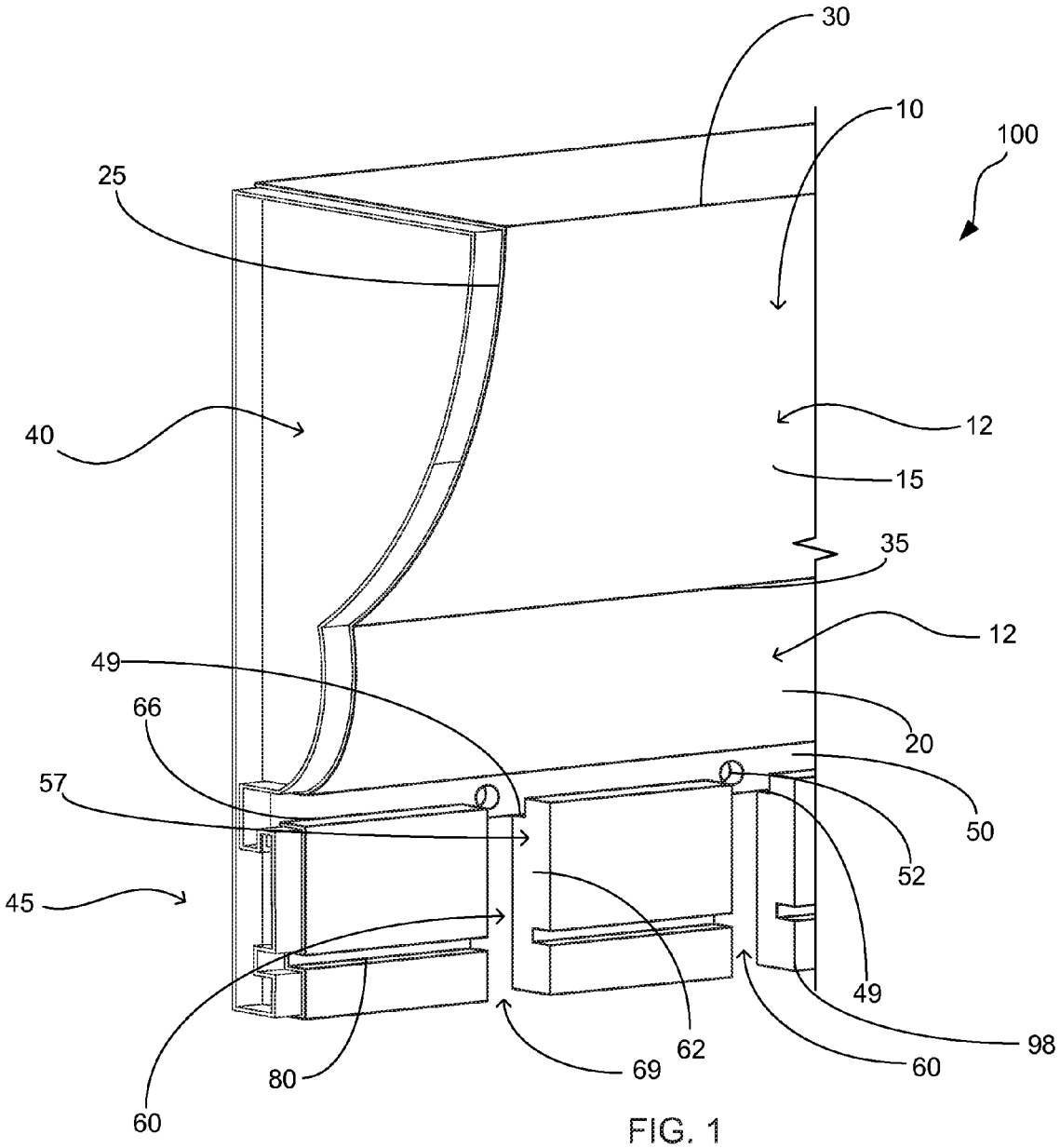
FIG. 1 is a perspective view of an embodiment of the present invention wherein the bottom cover member is removed.

Referring now to the drawings submitted herewith, wherein various elements depicted therein are not necessarily drawn to scale and wherein through the views and figures like elements are referenced with identical reference numerals, there is illustrated a decorative molding 100 constructed according to the principles of the present invention.

Referring in particular to FIG. 1 is a decorative molding 100 that further includes a body 10 that is generally elongated in shape. The body 10 is manufactured from a suitable durable material such as but not limited to wood or plastic. The decorative molding 100 illustrated in FIG. 1 is a style of crown molding. As is known in the art, crown molding is typically installed around the upper perimeter of a wall, typically inside a building, adjacent to the ceiling. While the decorative molding 100 illustrated herein is embodied as a style of crown molding, it is contemplated within the scope of the present invention that the decorative molding 100 could be constructed in numerous other types of molding embodiments. More specifically but not by way of limitation, the decorative molding 100 could be formed in alternative embodiments such as chair railing, window frame molding or door frame molding.

The body 10 further includes a first upper portion 15 and a second upper portion 20. The first upper portion 15 has an arcuate perimeter edge 25 that extends outward and downward from the upper edge 30. The upper edge 30 is generally proximate the ceiling of the interior of a convention room having walls and a ceiling subsequent the decorative molding 100 being mounted in its intended location wherein the decorative molding 100 is located proximate the upper region of the interior of a wall. The first upper portion 15 is generally convex in shape and extends the length of the body 10. While the first upper portion 15 is illustrated in the embodiment illustrated in FIG. 1 in a preferred shape, it is contemplated within the scope of the present invention that the first upper portion 15 could be shaped in numerous different decorative shapes having a perimeter edge 25 that is other than what is illustrated in FIG. 1. Contiguous with the first upper portion 15 is the second upper portion 20. The second upper portion 20 is generally convex in shape extending outward from the body 10 generally beginning at the intermediate edge 35 and subsequently returning towards the body 10 to create the desired shape. The second upper portion 20 is generally smaller than the first upper portion 15. It is contemplated within the scope of the present invention that the body 10 could include as few as one decorative upper portions being formed in a variety of shapes. More specifically but not by way of limitation, the first upper portion 15 and second upper portion 20 could be joined to create a single upper region formed in numerous possible shapes. Additionally, it is contemplated that the upper region 40 of the body 10 could be formed utilizing upper portions 12 of any quantity and/or shapes.

The lower region 45 of the body 10 further includes a channel 50. The channel 50 is generally square u-shaped in shape and recessed into the body 10. The channel 50 is configured to receive the first leg 80 of the bottom cover member 70 as shown in particular in FIG. 2. The channel 50 is of suitable size to frictionally engage the first leg 80 of the bottom cover member 70 so as to releasably secure the bottom cover member 70 to the body 10. The channel 50 extends in a lateral direction generally the length of the entire body 10. While the channel 50 is illustrated herein as being generally square u-shaped it is contemplated within the scope of the present invention that the channel 50 could be shaped in numerous different shapes to correspond with and frictionally engage the shape of the first leg member 80. Journaled substantially through the body 10 in the channel 50 are a plurality of apertures 52. The apertures 52 are generally round in shape and function to allow a fastener such as but not limited a screw or a nail to be inserted therethrough so as to engage a wall to which a user wishes to mount the decorative molding 100. Those skilled in the art will recognize that any number of apertures 52 having different shapes could be utilized to provide a method of allowing a fastener to be inserted therethrough so as to secure the decorative molding to a wall.

Integrally connected with the channel 50 are a plurality of slots 60. The slots 60 are integrally connected to the channel 50 are configured in a generally longitudinal direction such that the slots 60 are generally perpendicular to the channel 50. The slots 60 are recessed into the body 10 and are generally square u-shaped and function to receive therein at least a portion of the arm 90 of the suspension members 95. The slots 60 function to maintain the arm 90 of the suspension members 95 in a generally vertical position subsequent the decorative molding 100 being mounted to a wall. While the slots 60 are illustrated herein as being generally square u-shaped it is contemplated within the scope of the present invention that the slots 60 could be manufactured in numerous different shapes so as to mateably engage with a corresponding shape with the arm 90 of the suspension members 90. It is further contemplated within the scope of the present invention that any number of slots 60 could be formed in the body 10 so as to receive as few as or more than one suspension member 95.

A notch 49 is formed in the rear portion 57 of the lower region 45 of the body 10 proximate the channel 50 and the slots 60. The notch 49 is formed on each side 62 of the slot 60. The notch 49 is generally right angle in shape and functions to receive therein the top 91 of the suspension member 95. The notch 49 being located on each side 62 of the slot 60 permits both the left portion 92 and right portion 93 of the top 91 to be releasably secured into the channel 50 such that the top 91 is recessed below the rearward edge 66. The notch 49 functions to engage the top 91 of the suspension member 95 so as to facilitate the releasable securing of the suspension member 95 to the body 10. The notch 49 permits the top 91 of the suspension member 95 to be engaged such that the top 91 will be at least equal with or slightly below the rearward edge 66 of the lower region 45 so as not to inhibit the engagement of the first leg 80 with the channel 50 ensuing the bottom cover member 70 being engaged with the body 10. While the notch 49 is illustrated herein as being generally right angled in shape, it is contemplated within the scope of the present invention that the notch 49 could be formed in numerous different shapes so as to correspond with the shape of the top 91 of the suspension member 95 so as to facilitate mateable engagement and substantially not interfere with the engagement of the first leg 80 with the channel 50.

A groove 80 is located in the lower region 45 of the body 10. The groove 80 extends laterally generally the length of the body 10. The groove 80 is square u-shaped and functions to frictionally engage with the tongue 72 of the bottom cover member 70. The groove 80 frictionally engages with the tongue 72 so as to assist in the bottom cover member 70 being releasably secured to the body 10. While the groove 80 is illustrated herein as being generally square u-shaped, it is contemplated within the scope of the present invention that the groove 80 could be formed in numerous different shapes so as to frictionally engage with the shape of the tongue 72.

Figure 2:
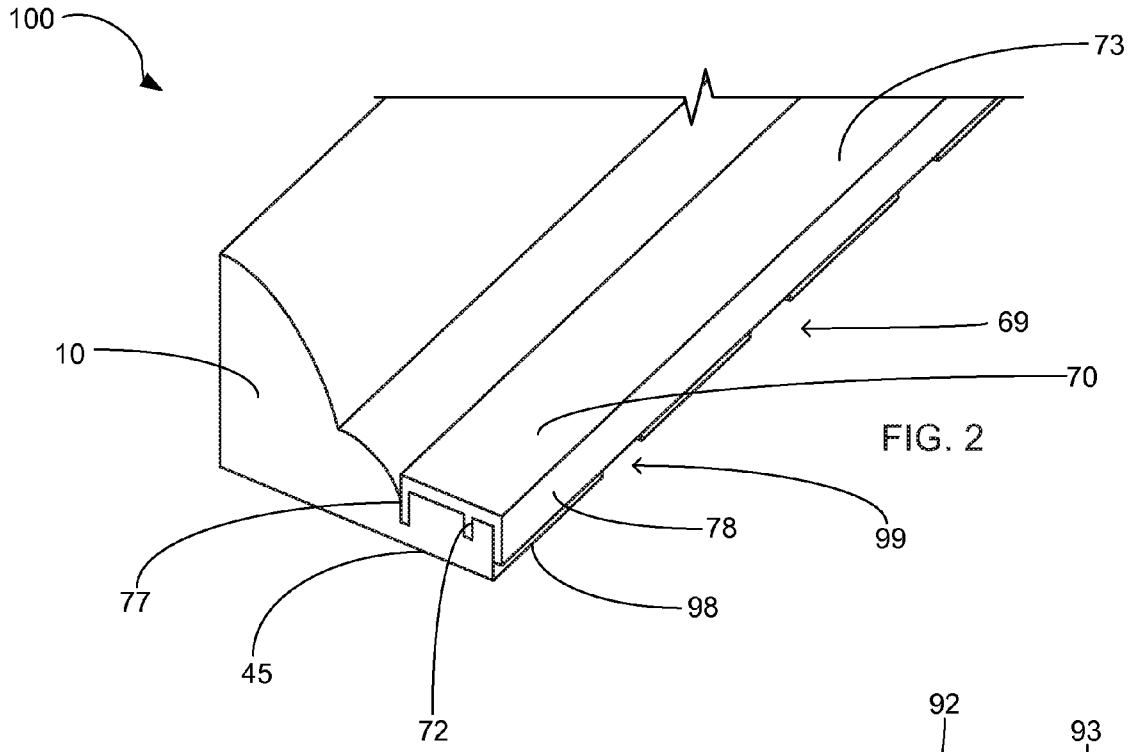
FIG. 2 is a perspective view of an embodiment of the present invention wherein the bottom cover member is releasably secured.

Referring in particular to FIG. 2, the bottom cover member 70 is illustrated being engaged with the lower region 45 of the body 10. The bottom cover member 70 includes a first leg 77, second leg 78, body member 73 and tongue 72. The body member 73 is generally rectangular in shape being configured in a substantially planar manner. The body member 73 function to substantially cosmetically cover the slots 60 of the lower region 45 of the body 10 in order to provide a more pleasing cosmetic appearance to the decorative molding 100. The first leg 77 is integrally formed with the body member 73 and is generally perpendicular therewith. The first leg 77 as previously discussed herein is operable to mateably and/or frictionally engage with the channel 50 so as to releasably secure the bottom cover member 70 to the lower region 45 of the body 10. The second leg 78 is contiguously formed with the body member 73 opposite the first leg 77. The second leg 78 is generally perpendicular with the body member 73 and functions to substantially cover the opening 69 of the slot 60. The second leg 78 has a length that allows a portion 99 of the opening 69 to remain uncovered subsequent the bottom cover member 70 being engaged with the body 10 so as to allow the arm 90 of the suspension member 95 to extend downward from the slot 60 substantially uninhibited by the second leg 78. Intermediate the first leg 77 and the second leg 78 is the tongue 72. The tongue 72 is integrally formed with the body member 73 and is generally perpendicular therewith. As previously discussed herein, the tongue 72 functions to frictionally and mateably engage with the groove 80 so as to facilitate the releasable securing of the bottom cover member 70 to the lower region 45 of the body 10.

Figure 3:
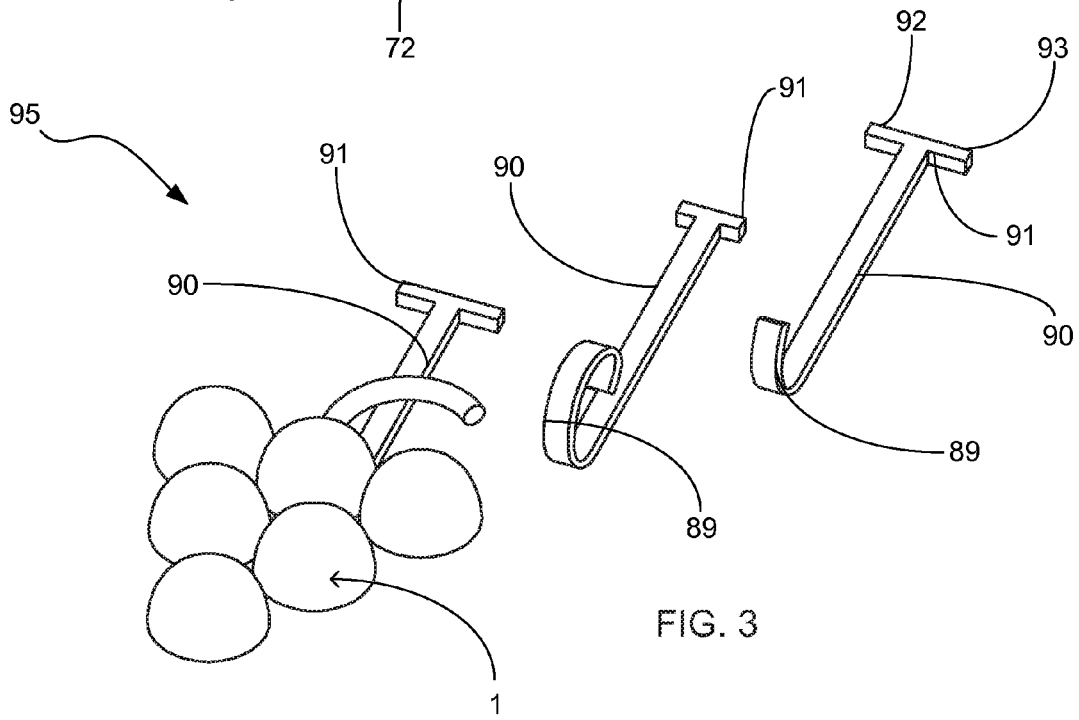
FIG. 3 is a perspective view of three embodiments of suspension members of the present invention.

Referring in particular to FIG. 3, there are illustrated three embodiments of the suspension members 95. The suspension members 95 are manufactured from a suitable durable material such as but not limited to wood, metal or plastic. The suspension members 95 are releasably secured to the lower region 45 of the body 10 extending downward therefrom providing a method of suspending an object adjacent to a wall in which the decorative molding 100 has been mounted so as to eliminate the need to fasten to the wall a traditional fastener such as a screw or a nail. Additionally, the suspension members 95 function to suspend an object adjacent to the wall to which the decorative molding has been mounted such that the object can be mounted without damage to the wall. The suspension members 95 further include an arm 90. The arm 90 is generally rectangular in shape and planar in manner. Integrally formed with the arm 90 is the top 91. The top 91 further includes a left portion 92 and right portion 91 forming a t-shape. As previously discussed herein the top 91 engages with the notch 49 present on each side 62 of the slot 60. The top 91 functions to releasably secure the suspension member 95 to the body 10 wherein the arm 90 extends downward from the slot 60 such that the arm extends beyond the lower edge 98 of the body 10. This allows the user to engage a desired object that the user wishes to suspend on a wall with the end 89 of the suspension member 95. It is contemplated within the scope of the present invention that the arm 90 could be manufactured in numerous different lengths so as to provide the user an option of suspending an object against the wall to which the decorative molding has been secured at a variety of heights. As shown in FIG. 3 the end 89 of the suspension member 95 is generally arcuate or hook-shaped. The end 89 is formed in such a manner so as to facilitate the improved retention of any object coupled therewith. Those skilled in the art will recognize that the end could be formed in numerous different shapes and still perform the desired function as described herein. A decorative member 1 is illustrated in FIG. 3. The decorative member 1 is secured to the suspension members 95 utilizing suitable durable methods. The decorative member 1 functions to provide an improved cosmetic appearance to the suspension member 95. While the decorative member 1 is illustrated herein as a grape bunch, it is contemplated within the scope of the present invention that the decorative member 1 could be formed in numerous different shapes or objects so as to improve the cosmetic appearance of the suspension member 95.

Referring in particular to FIGS. 1, 2 and 3 a description of the operation of the decorative molding 100 is as follows. In use, the decorative molding 100 is mounted to a desired wall proximate a ceiling utilizing suitable fasteners wherein the fasteners are inserted into the apertures 52. The user will then engage at least one suspension member 95 with the body 10 such that the top 91 mates with the notch 49 wherein the top 91 is at least equal to or below to rearward edge 66. The arm 90 of the suspension member 95 extends downward through the slot 60 and outward from the opening 69. Subsequent the user engaging at least one suspension member 95 with the lower region 45 of the body 10, the user will then engage the bottom cover member 70 with the body 10 such that the first leg 77 frictionally engages the channel 50 and the tongue 72 frictionally engages the groove 80 wherein the tongue 72 and the first leg 77 function to releasably secure the bottom cover member 70 to the body 10. The user will then hang a desired object on the suspension member 95 proximate the end 89 wherein the end 89 functions to releasably secure the object to the suspension member 95.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A decorative molding system secured to an interior surface of a wall of a structure comprising:

a body, said body being generally elongated and rectangular in shape, said body having an upper portion and a lower portion, said upper portion and said lower portion extending outward from the interior surface of the wall;

at least one suspension member, said at least one suspension member having a first end and a second end, said first end of said at least one suspension member configured to be releasably secured to said body, said second end of said at least one suspension member extending downward from said body, said second end of said at least one suspension member configured to hold an object proximate the interior surface of the wall beneath said body;

a channel, said channel being substantially the length of said body, said channel located on said lower portion of said body, said channel being configured in a generally horizontal manner along said lower portion of said body, said channel operable to receive said first end of said at least one suspension member; and a plurality of slots, said plurality of slots being configured in substantially a vertical orientation, said plurality of slots being located on said lower portion of said body, said plurality of slots perpendicularly coupled with said channel, said plurality of slots operable to receive a portion of said at least one suspension member, said plurality of slots for restricting the lateral movement of said at least one suspension member.

2. The decorative molding system as in claim 1, and further including a removable member, said removable member having a portion thereof operable to engage said channel, said removable member being superposed said lower portion of said body, said removable member operable to cosmetically veil said lower portion of said body.

3. The decorative molding system as recited in claim 2, and further including a plurality of apertures, said apertures being disposed in said channel, said apertures configured to receive a fastener so as to secure said body of the decorative molding system to the interior surface of the wall.

4. The decorative molding system as recited in claim 3, wherein the body of the decorative molding system is at least one of the following types of molding: crown molding, chair rail molding, window frame molding or door frame molding.

5. A decorative molding system secured to an interior surface of a wall of a room within a building wherein the decorative molding system is operable to suspend an object adjacent the interior surface of the wall beneath the body of the decorative molding system comprising:

a body, said body being generally elongated and rectangular in shape, said body having an upper portion and a lower portion, said upper portion and said lower portion being contiguously formed, said upper portion configured to be larger than said lower portion, a channel, said channel being substantially the length of said body, said channel located on said lower portion of said body, said channel being configured in a generally horizontal manner along said lower portion of said body;

a plurality of slots, said plurality of slots being configured in substantially a vertical orientation, said plurality of slots being located on said lower portion of said body, said plurality of slots engaging said channel in a generally perpendicular manner;

a plurality of suspension members, said plurality of suspension members having a first end and a second end, said plurality of suspension members further including a body, said first end being generally t-shaped, said second end being generally arcuate in shape, said first end configured to be operably coupled with said channel, said body of said plurality of suspension members being planar in manner, wherein at least a portion of said body of said plurality of suspension members is engaged with said plurality of slots;

and wherein said plurality of suspension members are operable to suspend an object against the interior surface of the wall beneath said body and separate therefrom.

6. The decorative molding system as recited in claim 5, wherein said plurality of slots are configured to restrict the lateral movement of said plurality of suspension members.

7. The decorative molding system as recited in claim 6, and further including a removable member, said removable member having a portion thereof operable to engage said channel, said removable member being superposed said lower portion of said body subsequent engaging said channel, said removable member operable to cosmetically veil said lower portion of said body.

8. The decorative molding system as recited in claim 7, wherein said removable member is generally square u-shaped, said removable member further including a first leg and a second leg, said first leg operable to releasably secure into said channel.

9. The decorative molding system as recited in claim 8, and further including a second channel, said second channel being parallel said channel, said second channel configured to releasably receive a portion of said removable member.

10. The decorative molding system as recited in claim 9, wherein the body of the decorative molding is at least one of the following types of molding: crown molding, chair rail molding, window frame molding or door frame molding.

* * * * *